US006361306B1

(12) United States Patent
Hinzpeter et al.

(10) Patent No.: US 6,361,306 B1
(45) Date of Patent: Mar. 26, 2002

(54) TOOL ASSEMBLY FOR THE MANUFACTURE OF RING-SHAPED COMPACTS USING A ROTARY COMPRESSION PRESS

(75) Inventors: Jürgen Hinzpeter; Ulrich Zeuschner; Christian Medicus, all of Schwarzenbek; Christian Hoffmann, Mölln; Jürgen Schikowski, Schwarzenbek; Andreas Arning, Talkau; Hans-Wilhelm Christiansen, Trittau, all of (DE)

(73) Assignee: Wilhelm Fette GmbH, Schwarzenbak (DE)

( * ) Notice: Subject to any disclaimer, the term of this patent is extended or adjusted under 35 U.S.C. 154(b) by 0 days.

(21) Appl. No.: 09/588,449

(22) Filed: Jun. 6, 2000

(30) Foreign Application Priority Data

Jun. 14, 1999 (DE) ..... 199 26 934

(51) Int. Cl.[7] ..... B30B 11/01
(52) U.S. Cl. ..... 425/193; 425/345; 425/353
(58) Field of Search ..... 425/182, 193, 425/344, 345, 353

(56) References Cited

U.S. PATENT DOCUMENTS

| | | | | |
|---|---|---|---|---|
| 4,057,381 A | * | 11/1977 | Korsh | 425/345 |
| 4,569,650 A | * | 2/1986 | Kramer | 425/353 |
| 5,882,696 A | * | 3/1999 | Fabbri | 425/193 |
| 5,928,590 A | * | 7/1999 | Fabbri | 425/345 |

FOREIGN PATENT DOCUMENTS

| | | |
|---|---|---|
| DE | 257844 | 10/1967 |
| DE | 26 04 648 | 10/1980 |
| DE | 298 01 312.6 | 3/1988 |

* cited by examiner

*Primary Examiner*—Nam Nguyen
*Assistant Examiner*—Thu Khanh T. Nguyen
(74) *Attorney, Agent, or Firm*—Vidas, Arrett & Steinkraus, P.A.

(57) ABSTRACT

A tool arrangement for the manufacture of ring-shaped compacts using a rotary compression press wherein the rotary compression press has a rotatably driven die-plate having die holes in which die inserts are mounted, and upper and lower rams aligned towards the die inserts and rotating together therewith, which are moved by control portions towards each other or away from each other and wherein the bottom rams have a coaxial bore open to the operating end in which a central pin is disposed which is axially located relative to the die-plate by a transverse pin wherein the transverse pin extends through an axial slot of the lower ram, wherein the transverse pin is located in a ring which forms part of a guide bore for the lower ram which is formed in a radially outwardly facing projection of the die-plate, two bracket-shaped retaining clips are disposed on opposed sides of the lower ram a longer leg of which abuts against the underside of the ring and a short, second leg of which is bent over the projection, a web interconnecting the legs is adapted to be connected to the projection via a bolted joint, the retaining clips and the die-plate being formed in such a way that the long leg, while the bolted joint is being tightened, is axially pressed against the ring towards the die.

9 Claims, 1 Drawing Sheet

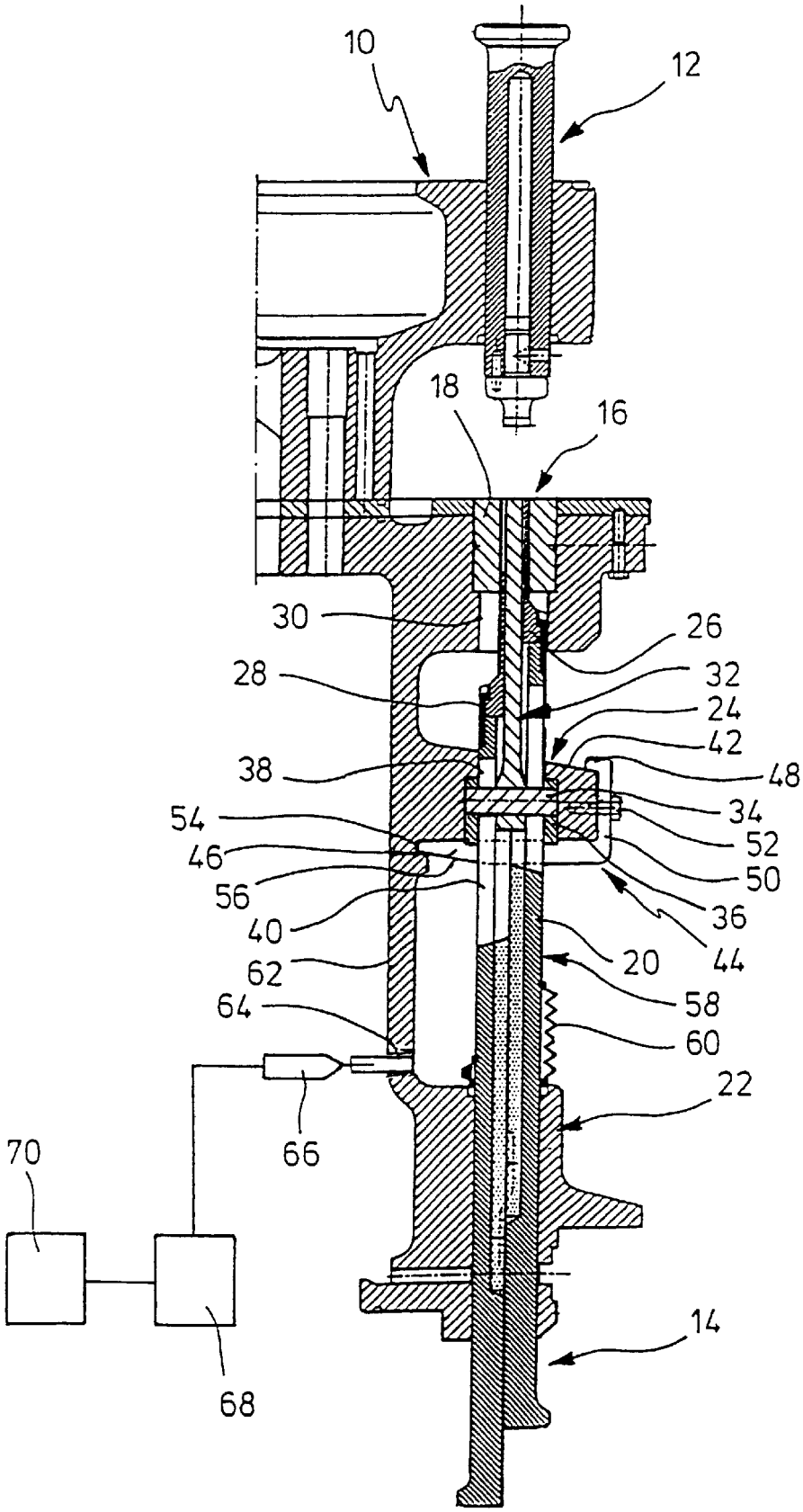
10
12
18
16
30
26
28
32
24
42
38
48
34
54
52
46
50
56
36
40
44
62
20
58
64
60
22
66
70
14
68

TOOL ASSEMBLY FOR THE MANUFACTURE OF RING-SHAPED COMPACTS USING A ROTARY COMPRESSION PRESS

CROSS-REFERENCE TO RELATED APPLICATIONS

Not Applicable

STATEMENT REGARDING FEDERALLY SPONSORED RESEARCH

Not Applicable

BACKGROUND OF THE INVENTION

The invention relates to a tool assembly for the manufacture of ring-shaped compacts using a rotary compression press.

A tool assembly of the aforementioned type has become known from DE 298 01 312. The transverse pin, which extends through the shank of the lower ram, which has a slot in this region, is disposed in a bore of the die insert. A tool assembly of this type is particularly advantageous if cylindrical and ring-shaped compacts are produced alternately. Any exchange of the die-plate may be completely dispensed with.

OE 257 844 has made known a tool assembly in which a transverse member to which the central pin is connected is pressed by a spring against a die-fixed shoulder. The transverse member extends through a transverse slot of the lower ram. In contrast to the above described tool arrangement, hence, the central pin is not kept stationary with respect to the die-plate.

It is the object of the invention to provide a tool assembly for the manufacture of ring-shaped compacts using a rotary compression press in which the central pin is adapted to be dismounted and mounted in a simple manner for reattachment in a reproducible position.

BRIEF SUMMARY OF THE INVENTION

In the inventive tool assembly, the transverse pin is located in a ring or ring-shaped sleeve which, in turn, is disposed in a guide bore for the shank of the lower ram, thus forming a part of the guide bore. The guide bore is formed on a radial projection of the die-plate, such guide bore not constituting the only guide of the lower ram. Two bracket-shaped retaining clips are disposed on opposed sides of the lower ram wherein a longer leg abuts against the underside of the ring and a shorter, second leg is bent over the projection. A web interconnecting the leg is connected to the projection via a bolted joint in such a manner that it may be radially bolted on against the projection from outside. If this is done an appropriate shape of the projection and the legs of the retaining clip causes the longer leg to exert an axial pressure onto the ring towards the upper ram and the die, which causes the ring to be safely held in the corresponding recess in the bore of the projection. To attain such effect, it is required for the ring to protrude, at least to a minimal degree, from the guide bore at the underside of the projection.

By means of the design described, the central pin is adapted to be dismounted by disconnecting the bolted joint in a simple and sufficient manner so that another lower ram having a central pin may be installed in a simple manner.

Cooperation between the retaining clip and the projection or the die-plate is preferably such as to provide conically shaped surfaces which interact, while the bolted joint is being tightened, so as to press the inner leg of the retaining clip against the retaining ring of the transverse pin.

The transverse pin preferably is of a cross-section having the shape of an elongated rectangle, the transverse pin being disposed edgewise in the ring and the central pin. This enables the transverse pin to absorb large forces and makes it less susceptible to flexure.

In another aspect of the invention, a radial bore is disposed at the lower end of a recess which is below the projection and within the area of which the lower ram is exposed. Air may be blown into the recess from the interior of the die-plate through a radial bore in order to blow away dust which might accumulate in this area. This may be accomplished in a way that a stationary nozzle is disposed at the level of the radial bore and allows compressed air to be expelled therefrom either continuously or intermittently. If air is forced out impulsively a suitable control may be effected via the rotation of the die-plate.

BRIEF DESCRIPTION OF THE SEVERAL VIEWS OF THE DRAWINGS

An embodiment of the invention will now be explained with reference to a drawing.

The single FIGURE shows a section through a portion of a die-plate of a rotary compression press.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated.

Referring to the FIGURE, a die-plate is outlined at 10 and has an upper ram 12 and a lower ram 14. The lower ram is shown in two different positions on the left and right of the central line. The right-hand position indicates the expulsion of a compact whereas the left-hand position is taken when charging is effected. A series of dies, one of which is shown at 16, is disposed in the central portion of die-plate 10 as seen from an axial position. The die is formed by a separate insert 18 which is inserted in an appropriate bore of die-plate 10.

The lower ram 14 has a shank 20 which is guided in a lower guide portion 22, and a guide portion 24 between the die 16 and the lower guide portion 22. Shank 20 serves as a holder for a ram insert 26 which is adapted to be attached to shank 20 by means of a threaded sleeve 28. Sleeve 28 is guided in a bore portion 30 which is below the die insert 18.

A central pin 32, which extends up to the upper edge of the die insert 18, is disposed in an axial bore of the lower ram 14. The pin, along with the ring-shaped cylindrical insert 26, for the manufacture of ring-shaped tablets. It has a cross through bore at the lower end, through which bore a transverse pin 34 is guided. The transverse pin is of a cross-section having the shape of an elongated rectangle and is guided edgewise through the cross bore of the transverse pin 34. The transverse pin is seated in appropriate radial bores of a ring 36, which is inserted in a bore 38 of guide portion 24. Ring 36 constititutes a part of the guide bore for shaft 20. Shaft 20 has an axial elongated slot 40 the axial extension of which is dimensioned such that the transverse pin 34 freely extends through the slot in each of the two positions on the left-hand and right-hand sides of the FIGURE and in each position therebetween. Consequently, the motions of the compacting ram 14 are not interfered with by the transverse pin.

As can be seen, the lower front-end face of ring 36 extends slightly beyond the underside of guid portion 24. Guide portion 24 may be a flange extending continuously around die-plate 10 or may comprise individual projections each of them is formed in the region of the rams or dies. The upper surface 42 of the projection slopes downwards to the outside in an oblique direction. The lower surface extends nearly horizontally.

What can be seen in the FIGURE is a bracket-shaped clip 44 which has a longer leg 46 and a shorter leg 48 extending nearly in parallel therewith, and a web which interconnects the legs. Web 50 is pressed against the outside of projection 24 by means of a threaded bolt 52.

The free end of the longer leg 46 engages a groove 54 of the die-plate, its underside having a conically shaped surface 56. The lower side of the groove may appropriately be of a conical shape. The short leg 48 also is conically shaped at its underside and interacts with the oblique surface 42. If bolt 52 is tightened the long leg 46 exerts a pressure onto ring 36, which causes the ring to be pressed upwards against the stop in bore 38.

The assembly described provides a second bracket-shaped clip which equals the bracket-shaped clip 44. The two bracket-shaped clips are disposed on opposed sides of shank 10.

Ring 36 has disposed at its underside die-sunk notches which are engaged by the long legs 54 of the two bracket-shaped clips 44. This secures ring 36 in its rotary position. It is necessary to secure its position in order that the transverse pin 34 is freely guided in slot 40.

A major recess 58, in which the shaft 20 moves freely, is formed between projection 24 and guide portion 22. Disposed between shank 20 and guide portion 22 is a lip-type packing 60 the upper end of which moves together with the motion of shank 20 as is apparent from the left-hand illustration of the FIGURE. Lip-type packing 60 prevents dust and other particles from entering the guide bore.

The wall 62 of the die-plate which defines recess 58 has formed in it a radial bore 64 which is radially aligned towards the lower ram 14. It is understood that a corresponding bore is provided for each lower ram. An air-blow nozzle 66, which is supplied with compressed air from an air-blow source 68, is disposed at the same level as the radial bores 64 with the source being activated via a control device 70. The control device may detect the rotation of die-plate 10 and cause a pressure surge every time a bore 64 is in front of nozzle 66. The compressed air may help in blowing out dust or other matter.

As is suggested by the illustration in the FIGURE the operation of the rotary compression press is not described in detail because it is known as such. The upper and lower rams 12, 14 are actuated by control portions and via pressurized rollers in a known way in order that the required motions may be performed during a full rotation or a half-rotation.

The above Examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. A tool arrangement for the manufacture of ring-shaped compacts using a rotary compression press wherein the rotary compression press has a rotatably driven die-plate (10) having die holes in which die inserts (18) are mounted, and upper and lower rams (12, 14) aligned towards the die inserts (18) and rotating together therewith, which are moved by control portions towards each other and away from each other and wherein the lower ram (14) has a coaxial bore open to the operating end in which a central pin (32) is disposed which is axially located relative to the die-plate (10) by a transverse pin (34 wherein the transverse pin (34) extends through an axial slot of the lower ram (14), characterized in that the transverse pin (34) is located in a ring (36) which forms part of a guide bore (38) for the lower ram (14) which is formed in a radially outwardly facing projection (24) of the die-plate (10), two bracket-shaped retaining clips (44) are disposed on opposed sides of the lower ram (14), wherein said retaining clips having a long leg (46) abuts against the underside of the ring (36) and a short, second leg (48) is bent over the projection (24), a web (50) interconnecting the legs (46, 48) is adapted to be connected to the projection (24) via a bolted joint (52), the retaining clips (44) and the die-plate (10) being formed in such a way that the long leg (46), while the bolted joint (52) is being tightened, is axially pressed against the ring (36) towards the die (16).

2. The tool assembly according to claim 1, characterized in that a conically shaped first surface is formed in a groove (54) of the die-plate (10) which is engaged by the long leg (46).

3. The tool assembly according to claim 1, characterized in that an oblique upper surface (42) of the projection (24) interacts with the short leg (48).

4. The tool assembly according to claim 1, characterized in that a portion of the ring (36) protruding downwards beyond the projection (24) has recesses which are engaged by the long leg (46).

5. The tool assembly according to claim 1, characterized in that the transverse pin (34) preferably is of a cross-section having the shape of an elongated rectangle and is disposed edgewise in the ring (36) and in a slot (40) of the central pin (32).

6. The tool assembly according to claim 1, characterized in that the die-plate (10) is provided, below the projection (24), with a radial recess (58) in which the lower ram (14) is exposed and which is defined downwards by a further guide portion (22) for the lower ram (14), and the die-plate (10) has a radial bore (64) for a passage of blown air.

7. The tool assembly according to claim 6, characterized in that the radial bore (64) is disposed at the lower end of the recess (58) of the die-plate (10).

8. The tool assembly according to claim 6, characterized in that a lip-type packing (60) is disposed between the lower guide portion (22) and the lower ram (14).

9. The tool assembly according to claim 1, characterized in that the lower ram (14) comprise a ram holder (20) and a ram insert (26) and the axial slot (40) is provided in the ram holder (20).

* * * * *